US009747755B2

(12) United States Patent
Kroon

(10) Patent No.: US 9,747,755 B2
(45) Date of Patent: Aug. 29, 2017

(54) METHOD OF GAMING, A GAMING SYSTEM AND A GAME CONTROLLER

(71) Applicant: Aristocrat Technologies Australia Pty Limited, North Ryde (AU)

(72) Inventor: James Kroon, Macquarie Park (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 703 days.

(21) Appl. No.: 14/196,287

(22) Filed: Mar. 4, 2014

(65) Prior Publication Data

US 2014/0248939 A1 Sep. 4, 2014

(30) Foreign Application Priority Data

Mar. 4, 2013 (AU) ..... 2013900730

(51) Int. Cl.
*A63F 9/24* (2006.01)
*G07F 17/34* (2006.01)
*G07F 17/32* (2006.01)

(52) U.S. Cl.
CPC ..... *G07F 17/34* (2013.01); *G07F 17/326* (2013.01); *G07F 17/3262* (2013.01); *G07F 17/3265* (2013.01)

(58) Field of Classification Search
CPC ..... G07F 17/32; G07F 17/326; G07F 17/3265
(Continued)

(56) References Cited

U.S. PATENT DOCUMENTS 5,417,432 A 5/1995 Dwyer
6,935,947 B1 8/2005 Singer et al.
7,029,045 B2 4/2006 Tumminaro
7,396,279 B2 7/2008 Berman et al.
7,654,898 B2 2/2010 Vancura
7,790,451 B2 9/2010 Yazaki et al.
(Continued)

FOREIGN PATENT DOCUMENTS

AU 2007231804 A1 5/2008
AU 2007231804 B2 3/2012
(Continued)

OTHER PUBLICATIONS

Gomez et al, "Wagering Game with Multiple Unlockable Arrays", U.S. Appl. No. 61/676,053, filed Jul. 26, 2012, p. 1-14.*

*Primary Examiner* — Jay Liddle
*Assistant Examiner* — Ryan Hsu
(74) *Attorney, Agent, or Firm* — McAndrews, Held & Malloy, Ltd.

(57) ABSTRACT

A gaming system comprises at least one display for displaying a main window and a plurality of activatable additional windows and a game controller. The game controller is arranged to activate one or more of the activatable additional windows in response to one or more activation conditions being met and conduct at least one game round. In each game round game outcomes are independently generated by the game controller for each of the main window and each active additional window, wherein for each window generation of a game outcome comprises selection of a plurality of symbols from a symbol set associated with the respective window for display at respective ones of a plurality of symbol display positions within the respective window, and upon a contributing symbol occurring in at least one active additional window, the game controller applies the contributing symbol to the game outcome displayed in the main window to form a modified game outcome and evaluates the modified game outcome to determine whether to make an award.

36 Claims, 9 Drawing Sheets

(58) Field of Classification Search
USPC ..... 463/20, 25
See application file for complete search history.

(56) References Cited

U.S. PATENT DOCUMENTS

| | | | | |
|---|---|---|---|---|
| 7,854,088 | B2 | 12/2010 | Kurachi | |
| 7,988,549 | B2 | 8/2011 | Little | |
| 8,074,986 | B1 | 12/2011 | Gebhart | |
| 8,109,823 | B2 | 2/2012 | Aoki | |
| 8,475,261 | B2 | 7/2013 | Little | |
| 2002/0183105 | A1* | 12/2002 | Cannon | G07F 17/32 463/16 |
| 2005/0052039 | A1 | 3/2005 | Tumminaro | |
| 2006/0058095 | A1 | 3/2006 | Berman et al. | |
| 2006/0172796 | A1 | 8/2006 | Vancura | |
| 2006/0264254 | A1 | 11/2006 | Aoki | |
| 2006/0281525 | A1 | 12/2006 | Borissov | |
| 2007/0284819 | A1 | 12/2007 | Ledger | |
| 2008/0096635 | A1 | 4/2008 | Power | |
| 2008/0146319 | A1 | 6/2008 | Yoshizawa | |
| 2008/0280673 | A1 | 11/2008 | Marks et al. | |
| 2009/0117644 | A1 | 5/2009 | Yazaki et al. | |
| 2009/0250873 | A1 | 10/2009 | Jones | |
| 2010/0064572 | A1 | 3/2010 | Kurachi | |
| 2013/0331173 | A1* | 12/2013 | Jaffe | G07F 17/3288 463/21 |
| 2014/0031100 | A1* | 1/2014 | Gomez | G07F 17/34 463/20 |
| 2014/0256411 | A1* | 9/2014 | Basallo | G07F 17/3267 463/25 |

FOREIGN PATENT DOCUMENTS

| | | | |
|---|---|---|---|
| CN | 1807608 | A | 7/2006 |
| CN | 101199830 | A | 6/2008 |
| CN | 1807608 | B | 7/2010 |
| CN | 101199830 | B | 3/2011 |
| ES | 2012964 | A6 | 4/1990 |
| GB | 2429657 | A | 3/2007 |
| GB | 2439143 | A | 12/2007 |
| GB | 2439386 | A | 12/2007 |
| JP | 2006255053 | A | 9/2006 |
| JP | 2007167507 | A | 7/2007 |
| JP | 2007267917 | A | 10/2007 |
| JP | 2008119392 | A | 5/2008 |
| JP | 2009183764 | A | 8/2009 |
| JP | 2009254555 | A | 11/2009 |
| JP | 4377905 | B2 | 12/2009 |
| JP | 2010063741 | A | 3/2010 |
| JP | 4658207 | B2 | 3/2011 |
| JP | 2011087956 | A | 5/2011 |
| JP | 2011120659 | A | 6/2011 |
| RU | 2007125784 | A | 1/2009 |
| RU | 2351987 | C1 | 4/2009 |
| TW | 200946187 | A | 11/2009 |
| WO | 0007434 | A1 | 2/2000 |
| WO | 2006041765 | A2 | 4/2006 |
| WO | 2007018680 | A2 | 2/2007 |
| WO | 2007018680 | A3 | 5/2007 |
| WO | 2006041765 | A3 | 7/2007 |

* cited by examiner

METHOD OF GAMING, A GAMING SYSTEM AND A GAME CONTROLLER

RELATED APPLICATIONS

This application claims priority to Australia Provisional Patent Application No. 2013900730 having an International filing date of Mar. 4, 2013, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

While existing gaming systems provide players with enjoyment, a need exists for alternative gaming systems in order to maintain or increase player enjoyment.

BRIEF SUMMARY OF THE INVENTION

In a first aspect, the invention provides a gaming system comprising:

at least one display for displaying a main window and a plurality of activatable additional windows; and a game controller arranged to:

activate one or more of the activatable additional windows in response to one or more activation conditions being met; and conduct at least one game round, wherein in each game round:

game outcomes are independently generated by the game controller for each of the main window and each active additional window, wherein for each window generation of a game outcome comprises selection of a plurality of symbols from a symbol set associated with the respective window for display at respective ones of a plurality of symbol display positions within the respective window, and upon a contributing symbol occurring in at least one active additional window, the game controller applies the contributing symbol to the game outcome displayed in the main window to form a modified game outcome and evaluates the modified game outcome to determine whether to make an award.

In an embodiment, the game controller is arranged to conduct a plurality of game rounds.

In an embodiment, in at least an initial game round none of the additional windows are active and a game outcome is only generated for the main window.

In an embodiment, none of the additional windows are active until a first activation condition is met.

In an embodiment, each activation condition is derived from one or more game outcomes in the main window.

In an embodiment, the game controller is arranged to keep a count of occurrences of an activation symbol in the main window and each activation condition is a number of occurrences of the activation symbol, the first activation condition being a first number of occurrences and each subsequent activation condition being a higher number of occurrences of the activation symbol.

In an embodiment, the activation symbol is also the contributing symbol.

In an embodiment, the additional windows are activated one at a time.

In an embodiment, at least one of the additional windows is activated in response to receiving a user selection subsequent to an activation condition being met.

In an embodiment, the game controller is arranged to conduct the at least one game round in response to a trigger condition being met in respect of a base game.

In an embodiment, the same symbol set is employed for each window.

In an embodiment, the symbol set comprises a plurality of sub-sets and the game outcomes are generated by selecting from each sub-set.

In an embodiment, the game outcome is represented as a plurality of spinning reels and each reel corresponds to a sub-set.

In a second aspect, the invention provides a game controller for a gaming system, the game controller arranged to:

control at least one display to display a main window and a plurality of activatable additional windows;

activate one or more of activatable additional windows in response to one or more activation conditions being met; and conduct at least one game round, wherein in each game round:

game outcomes are independently generated by the game controller for each of the main window and each active additional window, wherein for each window generation of a game outcome comprises selection of a plurality of symbols from a symbol set associated with the respective window for display at respective ones of a plurality of symbol display positions within the respective window, and upon a contributing symbol occurring in at least one active additional window, the game controller applies the contributing symbol to the game outcome displayed in the main window to form a modified game outcome and evaluates the modified game outcome to determine whether to make an award.

In an embodiment, the game controller is arranged to conduct a plurality of game rounds.

In an embodiment, in at least an initial game round none of the additional windows are active and a game outcome is only generated for the main window.

In an embodiment, none of the additional windows are active until a first activation condition is met.

In an embodiment, each activation condition is derived from one or more game outcomes in the main window.

In an embodiment, the game controller is arranged to keep a count of occurrences of an activation symbol in the main window and each activation condition is a number of occurrences of the activation symbol, the first activation condition being a first number of occurrences and each subsequent activation condition being a higher number of occurrences of the activation symbol.

In an embodiment, the activation symbol is also the contributing symbol.

In an embodiment, the additional windows are activated one at a time.

In an embodiment, at least one of the additional windows is activated in response to receiving a user selection subsequent to an activation condition being met.

In an embodiment, the game controller is arranged to conduct the at least one game round in response to a trigger condition being met in respect of a base game.

In an embodiment, the same symbol set is employed for each window.

In an embodiment, the symbol set comprises a plurality of sub-sets and the game outcomes are generated by selecting from each sub-set.

In an embodiment, the game outcome is represented as a plurality of spinning reels and each reel corresponds to a sub-set.

In a third aspect, the invention provides a method of gaming in a gaming system comprising a display, the method comprising:

displaying a main window on the display activating one or more activatable additional windows on the display in response to one or more activation conditions being met; and conducting at least one game round, wherein in each game round:

game outcomes are independently generated for each of the main window and each active additional window, wherein for each window generation of a game outcome comprises selection of a plurality of symbols from a symbol set associated with the respective window for display at respective ones of a plurality of symbol display positions within the respective window, and upon a contributing symbol occurring in at least one active additional window, the method comprises applying the contributing symbol to the game outcome displayed in the main window to form a modified game outcome and evaluating the modified game outcome to determine whether to make an award.

In an embodiment, the method comprises conducting a plurality of game rounds.

In an embodiment, in at least an initial game round none of the additional windows are active and a game outcome is only generated for the main window.

In an embodiment, none of the additional windows are active until a first activation condition is met.

In an embodiment, each activation condition is derived from one or more game outcomes in the main window.

In an embodiment, the method comprises keeping a count with the gaming system of occurrences of an activation symbol in the main window and wherein each activation condition is a number of occurrences of the activation symbol, the first activation condition being a first number of occurrences and each subsequent activation condition being a higher number of occurrences of the activation symbol.

In an embodiment, the activation symbol is also the contributing symbol.

In an embodiment, the additional windows are activated one at a time.

In an embodiment, the additional window is activated in response to receiving a user selection subsequent to an activation condition being met.

In an embodiment, the method comprises conducting the at least one game round in response to a trigger condition being met in respect of a base game.

In an embodiment, the same symbol set is employed for each window.

In an embodiment, the symbol set comprises a plurality of sub-sets and the game outcomes are generated by selecting from each sub-set.

In an embodiment, the game outcome is represented as a plurality of spinning reels and each reel corresponds to a sub-set.

In a fourth aspect, the invention provides computer program code which when executed implements the above method.

In a fifth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
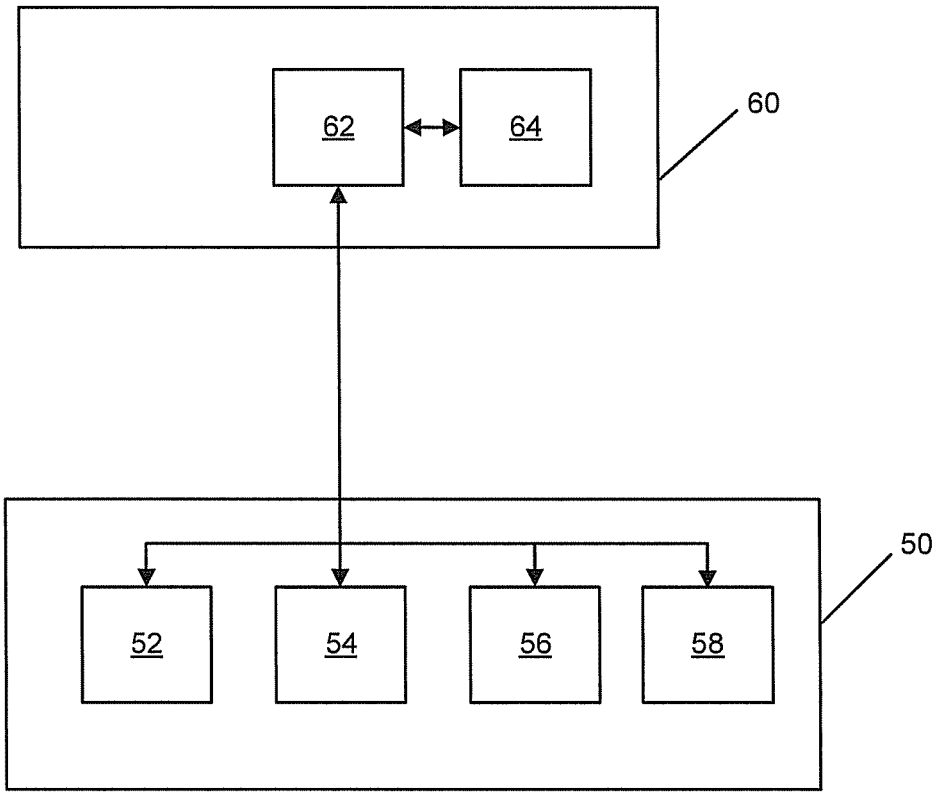
FIG. 1 is a block diagram of the core components of a gaming system.

Referring to the drawings, there is shown a gaming system having a game controller arranged to implement a game where game outcomes are generated in a main window and any active additional windows. Contributing symbols from active additional windows are applied to the main window to form a modified game outcome which is evaluated by the game controller to determine whether to make an award. In an embodiment, the additional windows are activated one by one in response to activation conditions being met.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
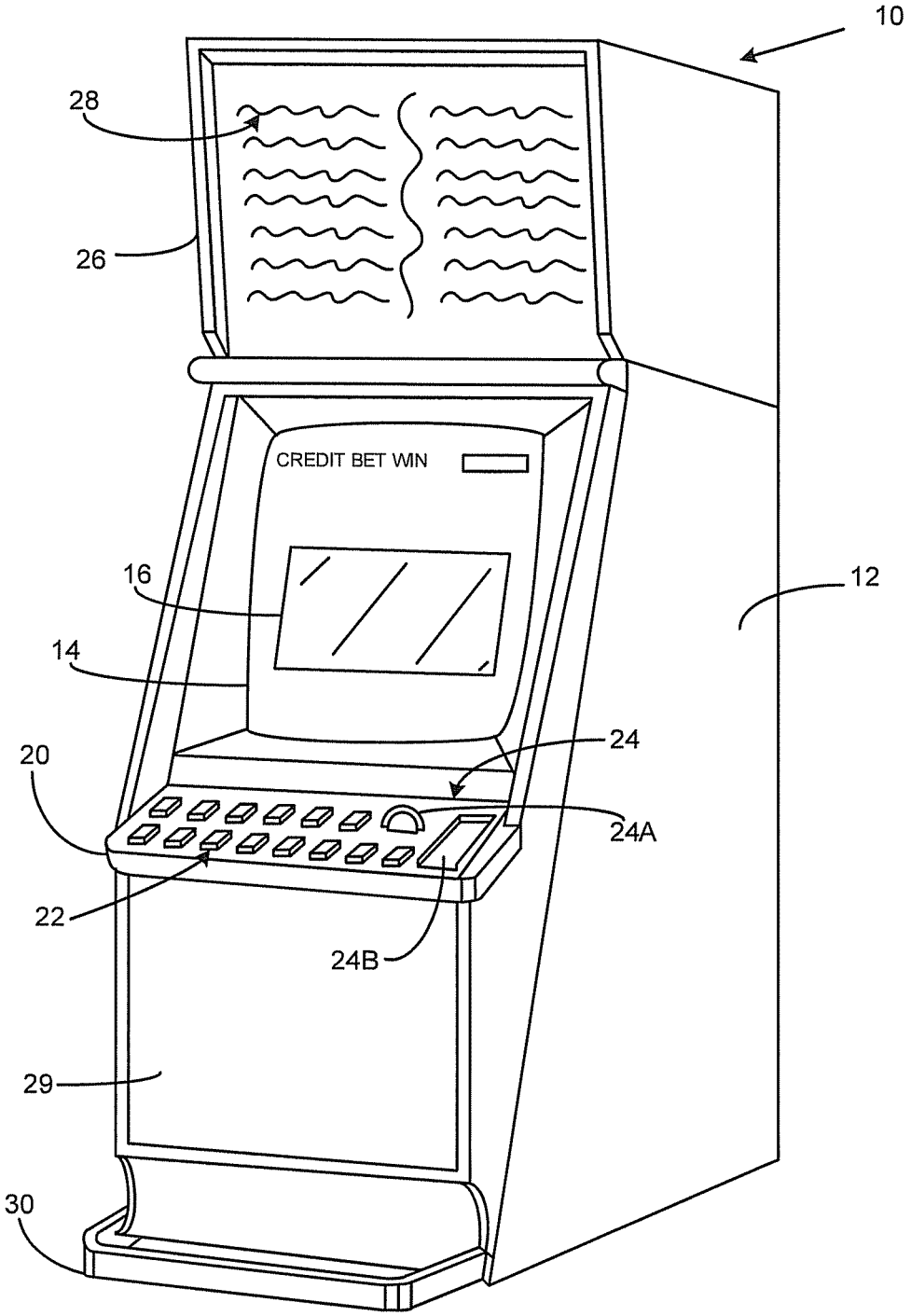
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
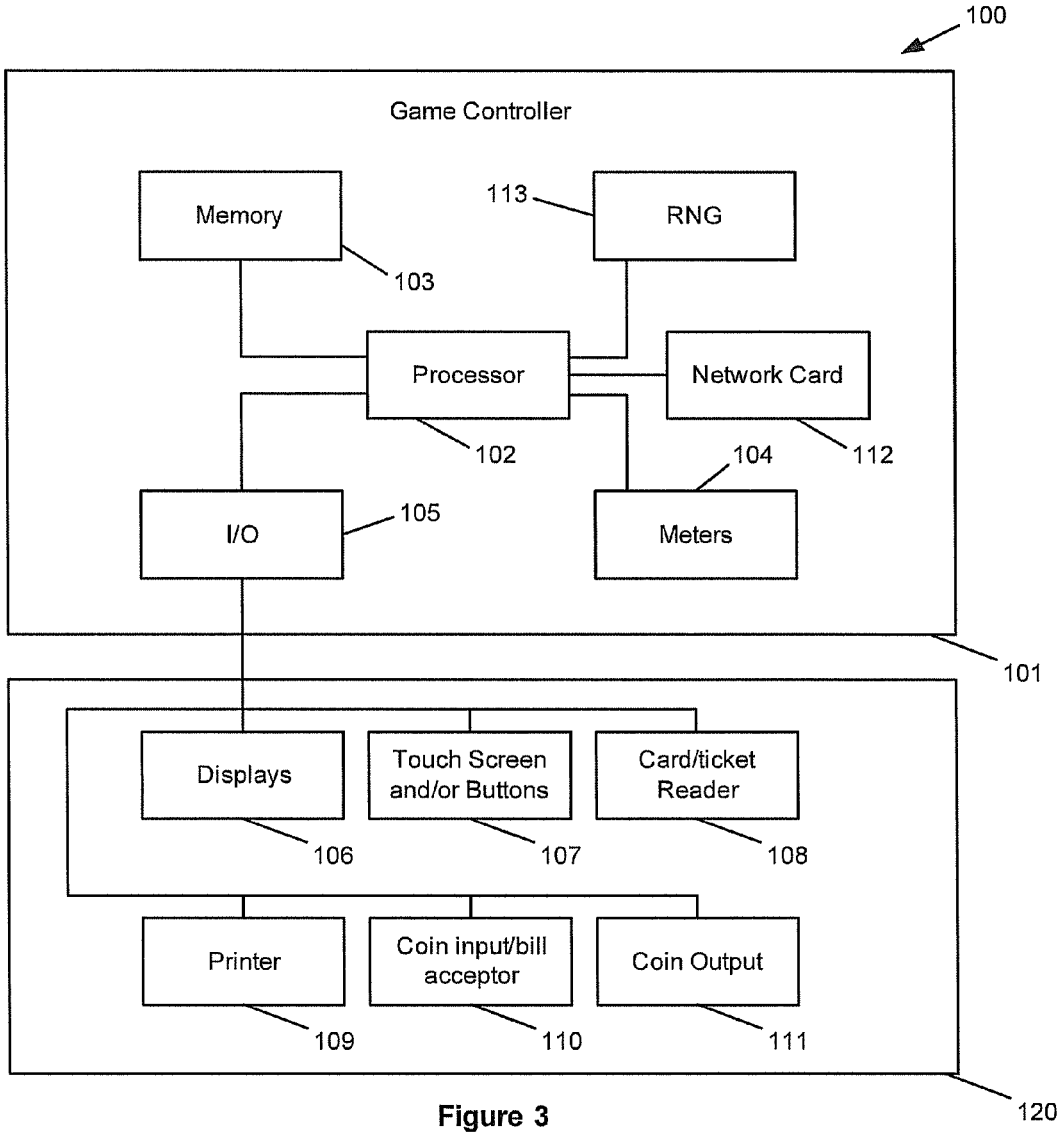
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
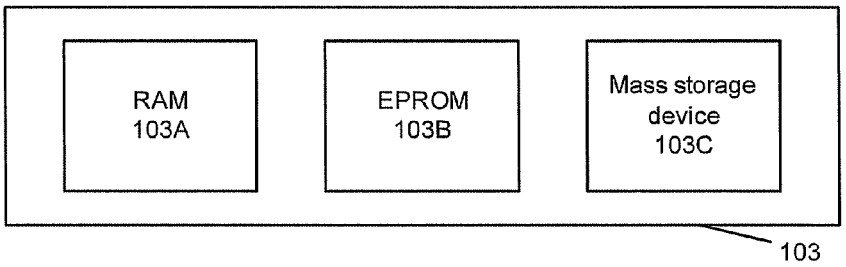
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
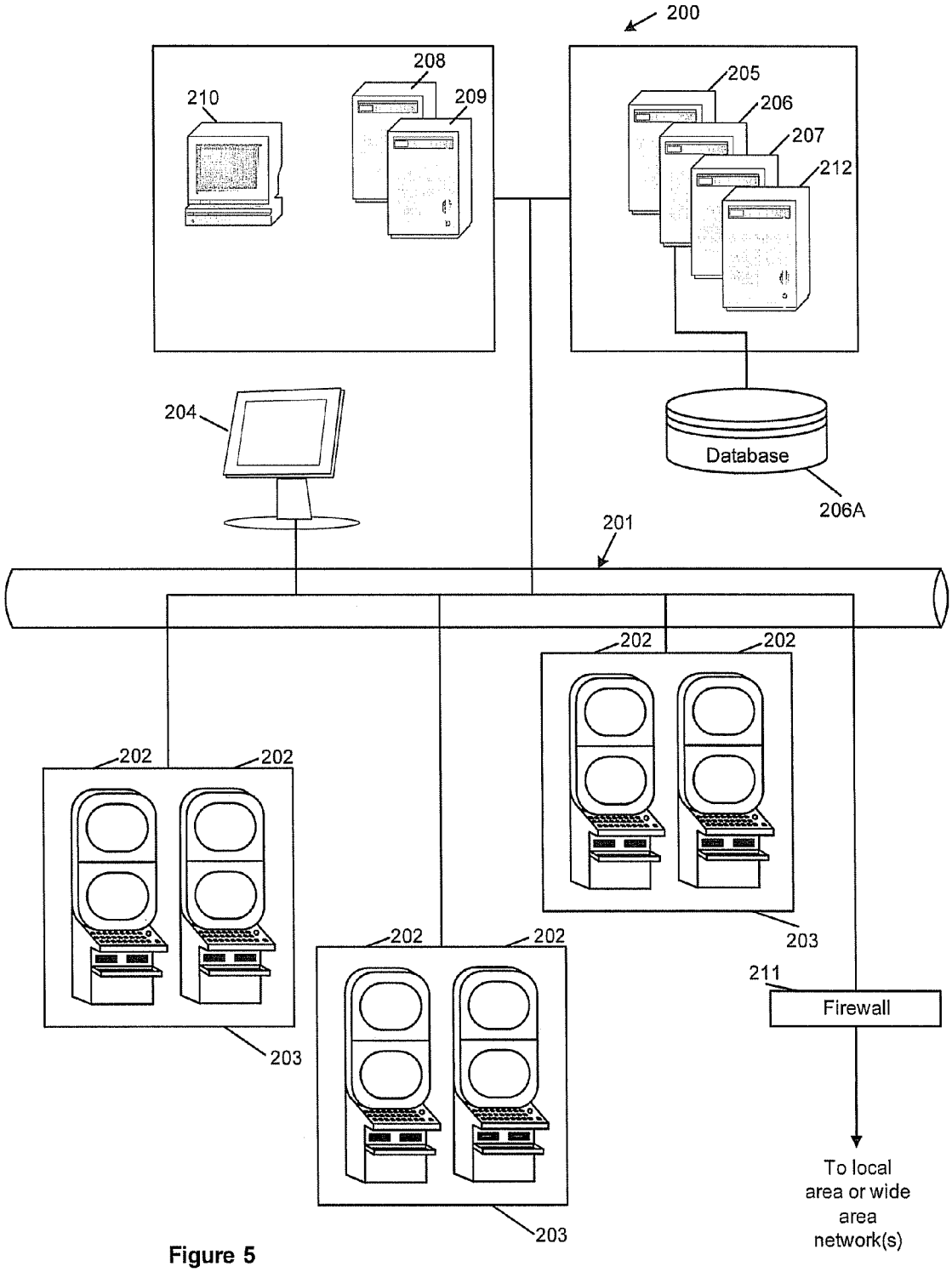
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art, will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g.

a first bet amount entitles the player to wins including cherries and a second amount entitles them to wins including plums.

In other embodiments a player may be able to place an ante bet. Depending on the embodiment, an ante bet may affect the manner in which games are evaluated, however, more typically the ante bet allows the player access to an additional aspect of game play that does not occur in games where an ante bet is not place. For example, the ante bet may allow access to a different feature game with a higher return to player or the rules of the feature game may be modified in return for an ante bet.

Figure 6:
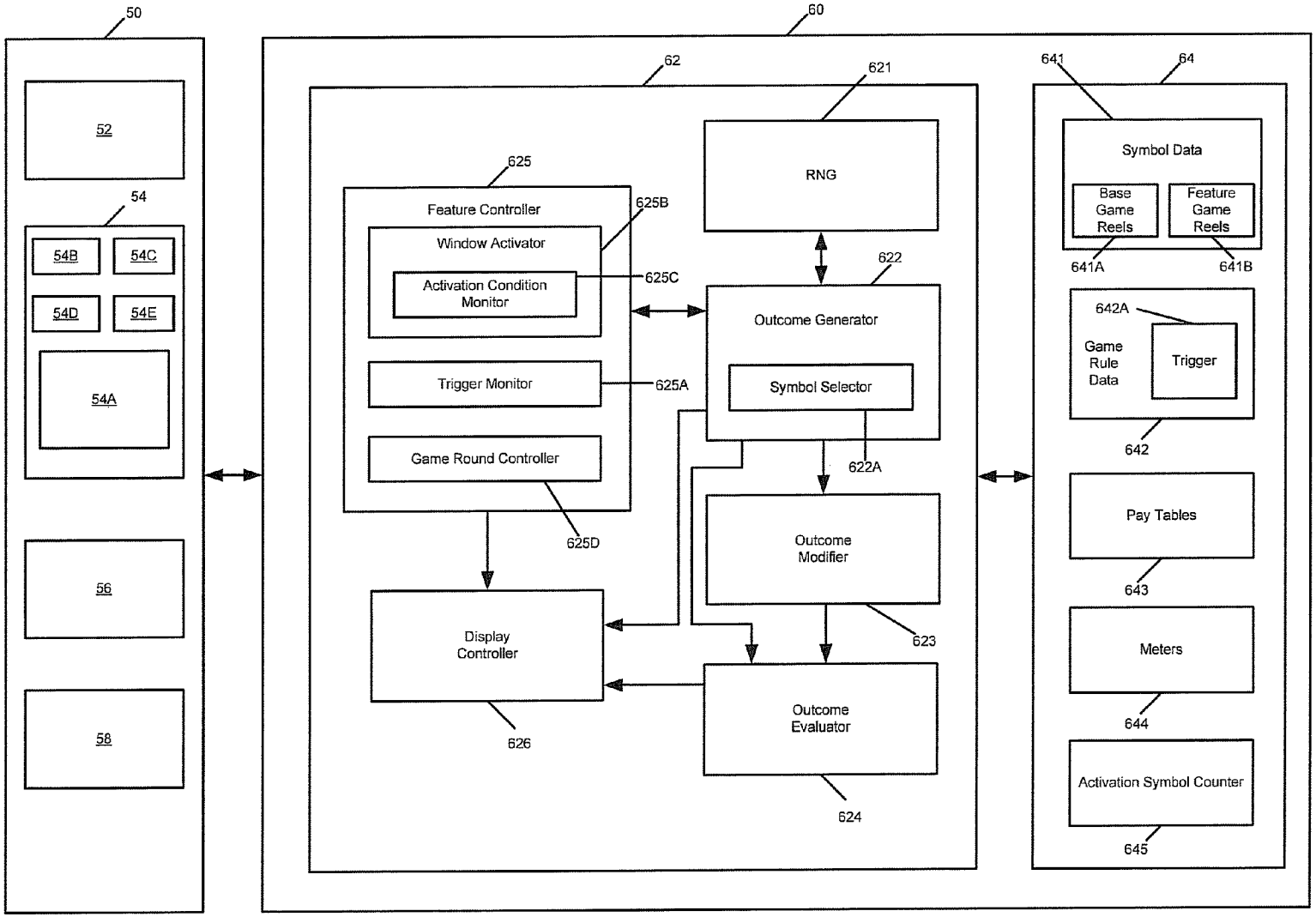
FIG. 6 is a further block diagram of a gaming system.

In FIG. 6, the processor 62 of game controller 60 is shown implementing a number of modules based on program code and data stored in memory 64. Persons skilled in the art will appreciate that one or more of the modules could be implemented in some other way, for example by a dedicated circuit.

These modules include the outcome generator 622 which operates in response to the player's operation of game play mechanism 56 to place a wager and initiate a play of the a game. In the embodiment, the game includes a base game and a feature game. The base game is a part of the game which is carried out each time the player makes a wager, irrespective of the wager amount, whereas the feature game will only be carried out occasionally when a condition is met such as a trigger event occurring during play of the base game.

Accordingly, in the embodiment the outcome generator generates a base game outcome which will then be evaluated by outcome evaluator 623. The first part of forming the game outcome is for a symbol selector 622A to select symbols from a set of symbols specified by symbol data 641 using random number generator 621. The selected symbols are advised to the display controller 626 which causes them to be displayed on display 54 at a set of display positions.

One example of selecting symbols is for the symbol selector 622A to select symbols for display from a plurality of symbol sets corresponding to respective ones of a plurality of spinning reels. In this embodiment, the symbol data 641 includes base game reels 641A. The base game reels 641A specify a sequence of symbols for each reel such that the symbol selector 622A can select all of the symbols to be displayed for each reel by selecting a stopping position in the sequence. In one example, three symbols of each of five reels may be displayed such that symbols are displayed at fifteen display positions on display 54. It is known to use a probability table stored in memory 64 to vary the odds of a particular stop position being selected. Other techniques can be used to control the odds of particular outcomes occurring to thereby control the return to player of the game.

After symbols of the base game are selected, they are evaluated by the outcome evaluator 624 based on a pay table 643 which lists a series of symbol combinations and awards that correspond to those combinations, typically in amounts of credit. Any awards are added to the credit meter stored as part of meter data 644. Any awards are displayed on the display under the control of the display controller 626.

In the embodiment, a further possible outcome of the generation of a game outcome in the base game is that a trigger condition can be met. In the embodiment, the trigger is the occurrence of a symbol combination in the game outcome, but other triggers may be employed such as the occurrence of a specific symbol in the game. In some embodiments, triggers be based on turnover on the game or based on some form of random evaluation.

The trigger condition 642*a* is specified as part of game rule data 642. The game controller 60 implements a feature game controller 625 which includes a trigger monitor 625*a* which monitors the base game outcomes to determine whether a trigger condition has been met.

In response to the trigger monitor 625*a*, determining that a feature game is to be conducted, the feature game controller 625 initiates a series of additional game rounds often known in the art as a free game series. In this respect, feature controller 625 also has a game round controller 625*d* which sets an initial number of game rounds based on game rule data 642 and keeps track of whether the game rounds have been played until all the games have been played and the feature game ends. In this respect, the number of game rounds that are awarded may be dependent on aspects of the game rules 642, for example, the number of occurrences of a symbol in the trigger conditions. For example, one commonly used trigger condition is the occurrence of scatter symbols and 3, 4, and 5 scatter symbols may trigger different numbers of additional game rounds.

The feature controller 625 also controls the display controller 626 to alter the display to display a main window 54A and four additional windows 54B to 54E. Further, the feature controller controls the outcome generator so that symbol selector 622A will select game outcomes using feature game reels 641B. In the embodiment, the feature game reels 641B are different to the base game reels 641A. In this respect, persons skilled in the art will appreciate that there are a number of ways to make feature game reels different to base game reels such as replacing the base game reels with a completely different set of feature game reels or using an overlay reel containing symbols at some positions and blanks symbols at other positions such that where the overlay reel overlays the base game reel, it modifies the base game reel by replacing the symbol of the base game reel. Another way of modifying base game reels is to add additional symbols the base game reel. Depending on how this is implemented, this can be achieved by actively modifying the reels or replacing them with reels with the additional symbols to achieve the effect of adding symbols to the reels. The feature game reels may use the same or different symbols to the base game reels. For example, the feature game reels may use the same symbols but have a higher proportion of high value symbols. In another example, one or more symbols from the base game reels may "change" when the game transitions to use of the feature game reels.

In the embodiment, at the beginning of the feature game, only the main window 54A is active and the other four additional windows are shown as inactive. In this respect, it will be appreciated that there may be a different number of additional windows that may be activated. It will also be appreciated that the availability of additional windows or the number of additional windows that are available may be dependent on factors such as the player's wager. For example, additional windows may only be available when an ante bet is placed.

Further, it will be appreciated that the additional windows need not necessarily be displayed on the same display 54 as the main window. Indeed, as described above many gaming machines include an additional top box display which is suitable for display of the additional windows. Further, persons skilled in the art will appreciate that inactive additional windows may not be displayed. However, in the embodiment, it is preferred that the windows are displayed in a manner that indicates that they are inactive so that the player understands that the windows can be activated as play continues.

In this respect, depending on the embodiment, game outcomes may be generated for the inactive additional windows but not evaluated or game outcomes may only be generated for the additional windows 54B to 54E when they are active.

Accordingly, as indicated above, during a first game round of the series of game rounds, a game outcome will only be evaluate for the main window. Accordingly, the outcome generator 622 generates a game outcome in the same manner as described in relation to the base game and this is evaluated by the outcome evaluator 624 based on the pay table 643 which may be the same or different to that of the base game. At the conclusion of the game round, an activation condition monitor 625C of the feature controller determines whether a window activation condition which forms part of game rule data 642 has been met. In an embodiment, the activation condition may be that a count of an activation symbol occurring in game outcomes during a feature game has reached a threshold level. To this end, an activation symbol counter 645 controlled by the activation condition monitor 625C is maintained in the memory 64. Accordingly, at the end of each game round, the activation condition monitor 625C updates the count 645 in the memory 64 and compares the count with a threshold. In this respect, in the embodiment, the windows 54B to 54E are activated one by one based on particular thresholds being reached. Accordingly, there are, in effect, four activation conditions. Depending on how frequently the activation symbol occurs, a different number of additional windows will be activated during the course of play of different feature game.

Once an activation condition has been met, a window activator activates one or more of the additional windows 54B to 54E such that in the next game round an additional window will be available for evaluation as will be described in further detail below.

In the preferred embodiment, the window activator 625B causes display controller 626 to display a message to a player on the display 54 to select which one of the windows they wish to activate. The player operates the game play mechanism 56, for example, by touching the window on the touch screen to activate a selected window. The game controller 60 receives the selection and the window activator 625B causes the display controller to control the display to show the selected window as active.

Accordingly, once one or more additional windows are active, in each game round thereafter, the outcome generator 622 generates outcomes that will be evaluated for each of the active windows. In the embodiment, contributing symbols of the additional windows 54B to 54E are used to modify the outcome in the main window 54A before the main window is evaluated. In one example, the contributing symbol is a special symbol with an additional game play characteristic such as a WILD symbol. In a preferred embodiment, occurrence of the WILD symbol in any active additional window is transferred to the corresponding position on the main window. For example, if each of the windows displays a 5×3 array of symbols corresponding to 5 reels with 3 symbol positions per reel, and a WILD symbol occurs in the top most position of the second from left reel in one of the additional windows, the WILD symbol is applied to the main window by being displayed at the top position of the second from left reel of the main window.

Accordingly, it will be appreciated that as a WILD symbol may substitute for all other symbols, the occurrence of a contributing symbol results in increased likelihood of awards being made from the pay table and in those awards being of higher value.

In the embodiment, the outcome evaluator 625 determines whether to make awards from each of the main window and the additional windows based on the pay table 643. However, it will be appreciated by persons skilled in the art that in other embodiments, only the main window may be evaluated.

In the embodiment, the contributing symbol is also used as the activation symbol.

Figure 7:
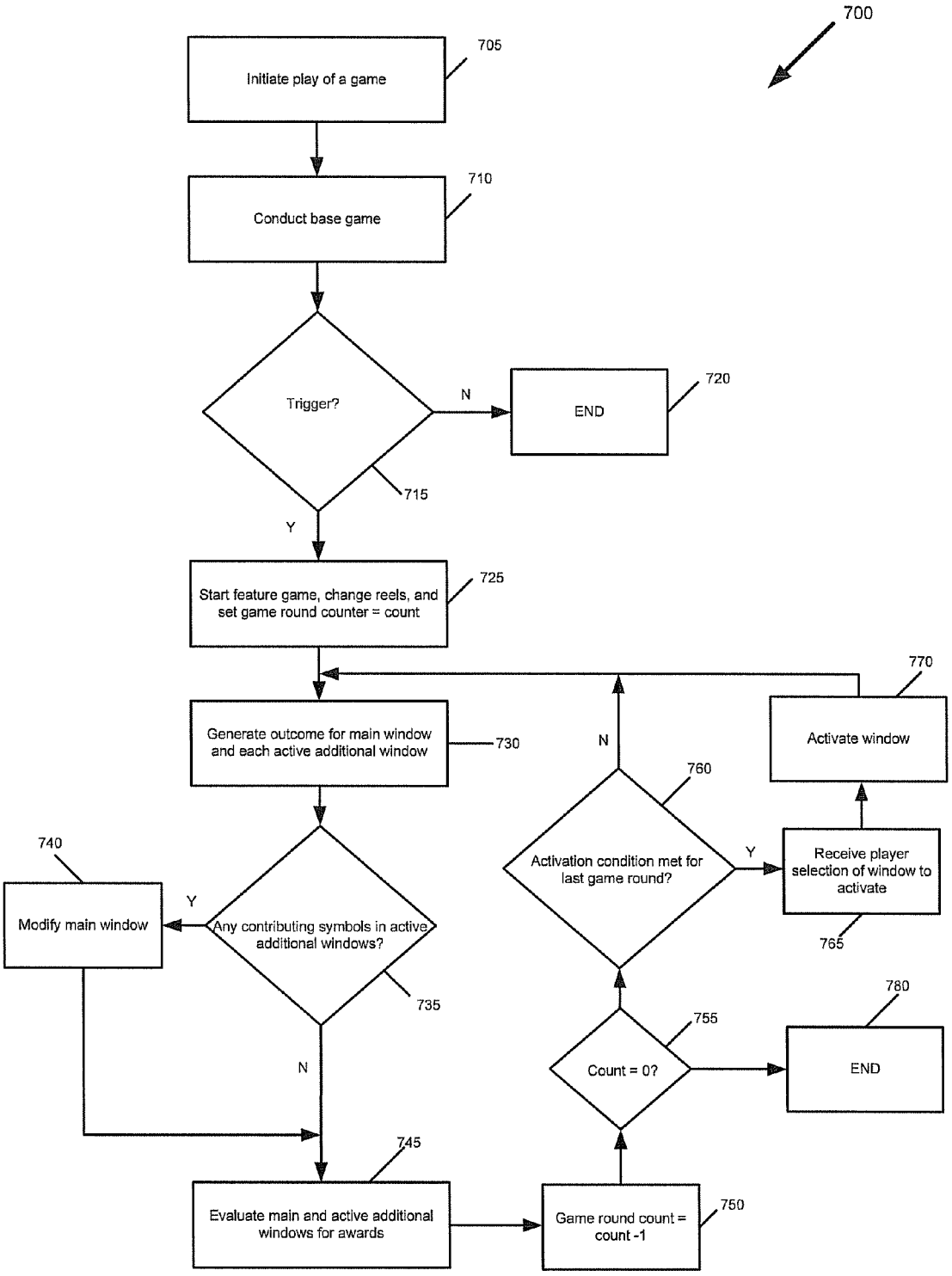
FIG. 7 is a flow chart of an embodiment.

The method of the invention is summarized in FIG. 7. The method 700 involves initiating play of a game 705. A base game is conducted 710. It is determined 715 whether a trigger condition is met and if not the game ends 720. If a trigger condition is met, a feature game is started where the reels are changed and a game round counter is set to an initial value (e.g. a count) 725.

During the feature game, outcomes are generated 730 for the main window and each active additional window (in the sense that they will be evaluated for the active additional windows at least to the extent that they may modify the main window). At step 735, it is determined whether there are any contributing symbols in active additional windows. If there are, the main window is modified 740 and in either event, the game controller proceeds by evaluating 745 the main and any active additional windows for awards.

After the main and any active additional windows have been evaluated, the game round counter is decreased by one by the game round controller 625D and if the count equals zero 755, the game ends 780. Otherwise, it is determined 760 whether an activation condition was met by the last game round and if so, the game controller proceeds to the receive 765 a player selection of a window to activate and activates the window 770 before generating a further game outcome at 730.

In this respect, a timer may be applied to a player activating a window such that the game controller may select a window if the player takes too long. Further, it will be appreciated that once all bar one activatable window has been activated, the player may not be required to activate the final window and this can be done automatically by the game controller once the final threshold is achieved.

Figure 8:
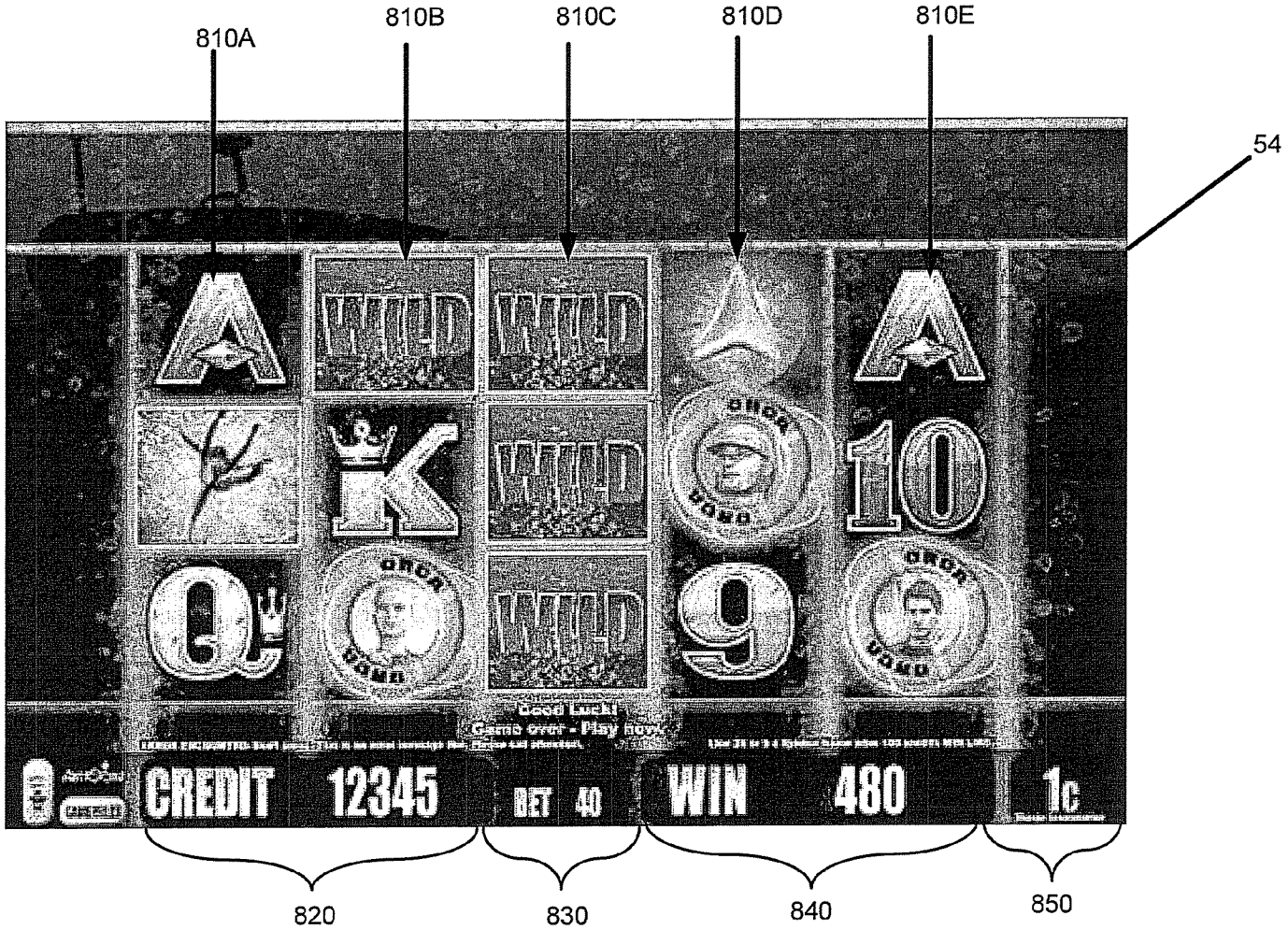
FIG. 8 shows an example of a screen shot of a display during a base game.

Referring now to FIG. 8, there is shown an example of a display 54 during conduct of a base game, the game involves selecting symbols for 5 reels 810A to 810E where three symbols are displayed for each reel. The game displays 820 the amount bet in the current game 830 and a win meter 840 corresponding to the current game. The game also displays the denomination 850 played in the game.

Figure 9:
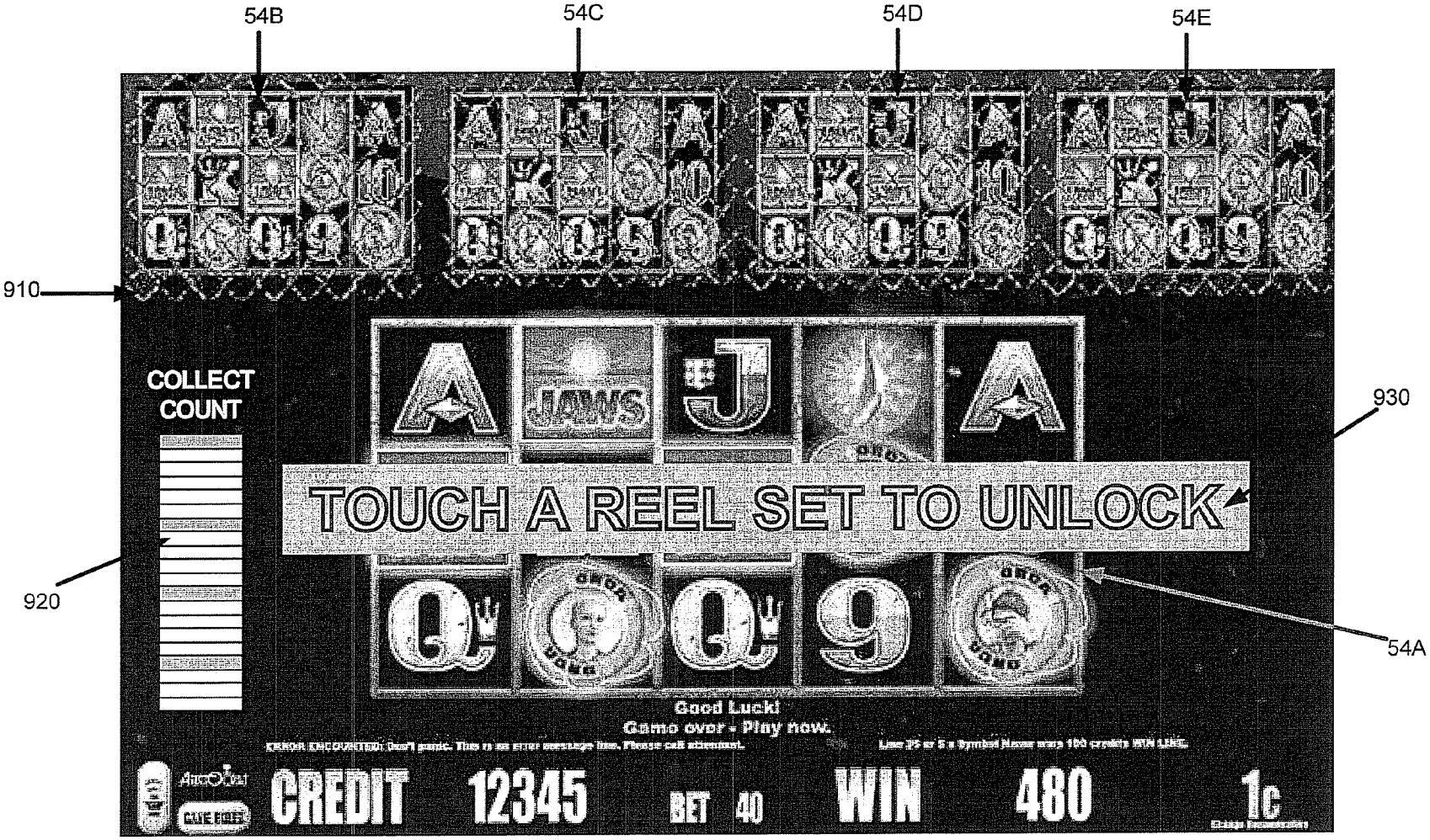
FIG. 9 shows an example of a screen shot of a display during a feature game.

FIG. 9 shows an example of the display during play of a feature game in accordance with the embodiment. In this example, there is a main window 54A and four additional windows 54B to 54E shown on display 54. The game also displays a counter 920 showing the number of activation symbols needed to be collected in order to activate an additional window. At the stage of the game shown in FIG. 9, a message 930 is displayed to the player to indicate that they have unlocked an additional window and may activate the window by touching one of the windows. In this respect, the windows are shown as locked by the depiction of cages 910 over the windows.

Figure 10:
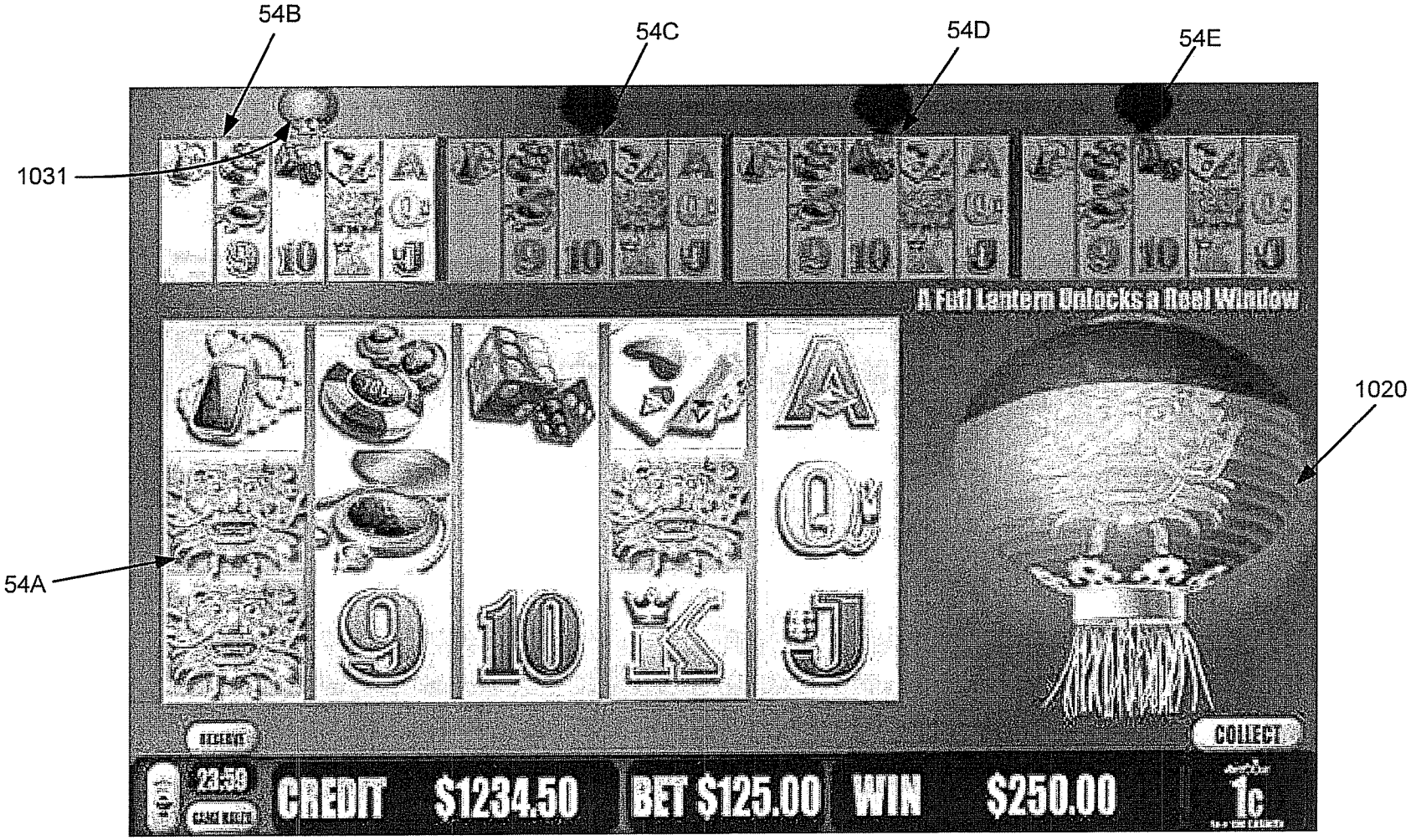
FIG. 10 shows another example of a screen shot of a display during a feature game.

FIG. 10 shows an alternative exemplary display again featuring a main window 54A and four sub windows 54B to 54E. FIG. 10 shows that the activation condition may be represented in a number of different ways. In FIG. 10 a lantern 1020 is shown which must be filled in order to activate an additional set of reels. When a lantern is lit, the player can touch the set of reels as the player has done in the exemplary display of FIG. 10 in order to activate reels 54B which as shown as lit up by lantern 1031 whereas the still locked reels 54C-54E are shown greyed out as if in darkness.

Persons skilled in the art will appreciate that in the above embodiment, there may be more than one game round in a play of a gaming machine when the feature game is awarded. As indicated above, in the embodiment, the outcome of a game round may be no win or a win from a winning combination of symbols resulting in an award. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine comprising:

a credit input mechanism to receive a physical item for representing a monetary value to establish a credit balance, the credit balance being increasable and decreasable based at least on wagering activity;

a credit meter configured to monitor the credit input based on the credit balance;

a display configured to, in accord with the established credit balance, display a main window and a plurality of activatable additional windows; and a game controller configured to:

count a number of occurrences of an activation symbol in the main window, wherein a first activation condition is a first number of occurrences, and a subsequent activation condition is a higher number of occurrences of the activation symbol;

activate one or more of the activatable additional windows in response to the number of occurrences of the activation symbol in the main window meeting a respective activation condition;

conduct at least one game round including:

independently generating game outcomes for each of the main window and each activated additional window, wherein each game outcome comprises a plurality of symbols selected from a symbol set associated with the activated additional window at a plurality of symbol display positions within the activated additional window, applying, upon a contributing symbol occurring in activated additional window, the contributing symbol to the game outcome displayed in the main window to form a modified game outcome, evaluating the modified game outcome to determine if the modified game outcome is a winning outcome, and incrementing a value of the credit meter if the modified game outcome is a winning outcome; and a payout mechanism configured to make an award based on the value of the credit meter.

2. A gaming machine as claimed in claim 1, wherein the game controller is configured to conduct a plurality of game rounds.

3. A gaming machine as claimed in claim 2, wherein in at least an initial game round none of the additional windows are active and a game outcome is only generated for the main window.

4. A gaming machine as claimed in claim 3, wherein none of the additional windows are active until a first activation condition is met.

5. A gaming machine as claimed in claim 4, wherein each activation condition is derived from one or more game outcomes in the main window.

6. A gaming machine as claimed in claim 3, wherein the additional windows are activated one at a time.

7. A gaming machine as claimed in claim 1, wherein the activation symbol is also the contributing symbol.

8. A gaming machine as claimed in claim 1, wherein at least one of the additional windows is activated in response to receiving a user selection subsequent to an activation condition being met.

9. A gaming machine as claimed in claim 1, wherein the game controller is configured to conduct the at least one game round in response to a trigger condition being met in respect of a base game.

10. A gaming machine as claimed in claim 1, wherein the game controller is further configured to employ the symbol set for each of the main window and each activated additional window.

11. A gaming machine as claimed in claim 10, wherein the symbol set comprises a plurality of sub-sets of symbols and wherein the game controller is further configured to generate the game outcomes by selecting symbols from each of the sub-sets.

12. A gaming system machine as claimed in claim 11, wherein the game controller is further configured to represent the game outcome as a plurality of spinning reels and each reel having one of the sub-sets of symbols.

13. A game controller for a gaming machine having a credit input mechanism to receive a physical item for representing a monetary value to establish a credit balance, the credit balance being increasable and decreasable based at least on wagering activity, a credit meter configured to monitor the credit input based on the credit balance, a display, and a payout mechanism, the game controller configured to:

control the display, in accord with the established credit balance, to display a main window and a plurality of activatable additional windows;

count a number of occurrences of an activation symbol in the main window, wherein a first activation condition is a first number of occurrences, and a subsequent activation condition is a higher number of occurrences of the activation symbol;

activate one or more of the activatable additional windows in response to the number of occurrences of the activation symbol in the main window meeting a respective activation condition;

conduct at least one game round including:

independently generating game outcomes for each of the main window and each activated additional window, wherein each game outcome comprises a plurality of symbols selected from a symbol set associated with the activated additional window at ones of a plurality of symbol display positions within the activated additional window, applying, upon a contributing symbol occurring in activated additional window, the contributing symbol to the game outcome displayed in the main window to form a modified game outcome, evaluating the modified game outcome to determine if the modified game outcome is a winning outcome, and incrementing a value of the credit meter if the modified game outcome is a winning outcome; and cause the payout mechanism to make an award based on the value of the credit meter.

14. A game controller as claimed in claim 13, wherein the game controller is configured to conduct a plurality of game rounds.

15. A game controller as claimed in claim 14, wherein in at least an initial game round none of the additional windows are active and a game outcome is only generated for the main window.

16. A game controller as claimed in claim 15, wherein none of the additional windows are active until a first activation condition is met.

17. A game controller as claimed in claim 16, wherein each activation condition is derived from one or more game outcomes in the main window.

18. A gaming system as claimed in claim 15, wherein the additional windows are activated one at a time.

19. A game controller as claimed in claim 13, wherein the activation symbol is also the contributing symbol.

20. A game controller as claimed in claim 13, wherein at least one of the additional windows is activated in response to receiving a user selection subsequent to an activation condition being met.

21. A game controller as claimed in claim 13, wherein the game controller is configured to conduct the at least one game round in response to a trigger condition being met in respect of a base game.

22. A game controller as claimed in claim 13, wherein the game controller is further configured to employ the symbol set for each of the main window and each activated additional window.

23. A game controller as claimed in claim 22, wherein the symbol set comprises a plurality of sub-sets of symbols and wherein the game controller is further configured to generate the game outcomes by selecting symbols from each of the sub-sets.

24. A game controller as claimed in claim 23, wherein the game controller is further configured to represent the game outcome as a plurality of spinning reels and each reel having one of the sub-sets of symbols.

25. A method of gaming in a gaming machine comprising a credit input mechanism to receive a physical item for representing a monetary value to establish a credit balance, the credit balance being increasable and decreasable based at least on wagering activity, a credit meter configured to monitor the credit input based on the credit balance, a payout mechanism, a game controller, and a display, the method comprising:

causing via the game controller, in accord with the established credit balance, to display a main window on the display and a plurality of activatable additional windows;

counting via the game controller a number of occurrences of an activation symbol in the main window, wherein a first activation condition is a first number of occurrences, and a subsequent activation condition is a higher number of occurrences of the activation symbol;

activating via the game controller one or more activatable additional windows on the display in response to the number of occurrences of the activation symbol in the main window meeting a respective activation condition;

conducting via the game controller at least one game round including:

independently generating game outcomes for each of the main window and each activated additional window, each game outcome comprises a plurality of symbols selected from a symbol set associated with the activated additional window at a plurality of symbol display positions within the activated additional window, applying, upon a contributing symbol occurring in activated additional window, the contributing symbol to the game outcome displayed in the main window to form a modified game outcome, evaluating the modified game outcome to determine if the modified game outcome is a winning outcome, and incrementing a value of the credit meter if the modified game outcome is a winning outcome; and cause the payout mechanism to make an award based on the value of the credit meter.

26. A method as claimed in claim 25, comprising conducting a plurality of game rounds.

27. A method as claimed in claim 26, wherein in at least an initial game round none of the additional windows are active and a game outcome is only generated for the main window.

28. A method as claimed in claim 27, wherein none of the additional windows are active until a first activation condition is met.

29. A method as claimed in claim 28, wherein each activation condition is derived from one or more game outcomes in the main window.

30. A method as claimed in claim 27, wherein the additional windows are activated one at a time.

31. A method as claimed in claim 25, wherein the activation symbol is also the contributing symbol.

32. A method as claimed in claim 25, wherein at least one of the additional windows is activated in response to receiving a user selection subsequent to an activation condition being met.

33. A method as claimed in claim 25, comprising conducting the at least one game round in response to a trigger condition being met in respect of a base game.

34. A method as claimed in claim 25, wherein the game controller is further configured to employ the symbol set for each of the main window and each activated additional window.

35. A method as claimed in claim 25, wherein the symbol set comprises a plurality of sub-sets of symbols and wherein the game controller is further configured to generate the game outcomes by selecting symbols from each of the sub-sets.

36. A method as claimed in claim 35, wherein the game controller is further configured to represent the game outcome as a plurality of spinning reels and each reel having one of the sub-sets of symbols.

* * * * *